United States Patent [19]

Ahrens

[11] 3,993,304

[45] Nov. 23, 1976

[54] AMUSEMENT RIDE APPARATUS

[76] Inventor: Claude W. Ahrens, P.O. Box 275, Grinnell, Iowa 50112

[22] Filed: July 11, 1975

[21] Appl. No.: 595,097

[52] U.S. Cl. ..... 272/17; 272/36; 272/50

[51] Int. Cl.[2] ..... A63G 31/16

[58] Field of Search ..... 272/17, 50, 51, 49, 272/36, 30, 31 R, 54, 56, 1 R, 48

[56] References Cited

UNITED STATES PATENTS

| | | | |
|---|---|---|---|
| 798,392 | 8/1905 | Cobley et al. | 272/50 |
| 1,465,012 | 8/1923 | Kohler | 272/50 |
| 1,589,286 | 6/1926 | Zabel | 272/31 R X |
| 1,661,864 | 3/1928 | Zabel | 272/31 R X |
| 1,661,865 | 3/1928 | Zabel | 272/31 R X |

FOREIGN PATENTS OR APPLICATIONS

| | | | |
|---|---|---|---|
| 993,957 | 8/1951 | France | 272/36 |

*Primary Examiner*—Paul E. Shapiro
*Assistant Examiner*—Arnold W. Kramer
*Attorney, Agent, or Firm*—Rudolph L. Lowell

[57] ABSTRACT

The apparatus simulates a motorcycle ride over an irregular terrain and has a pair of cycles arranged at transversely opposite sides of the apparatus supported at the opposite ends of a common supporting structure. A horizontal rotatable drive member and a horizontal stationary member thereabove support the opposite ends of an upright gyrating motion transmitting member by ball and socket joint connections; the connection with the drive member being offset from the axis thereof and the connection through the stationary member being coincident with the axis of rotation of the drive member. The supporting structure is mounted on the upper end of the gyrating motion transmitting member and is guidably confined against rotation in a horizontal plane so that the opposite ends of the supporting structure are reciprocally movable in a substantially vertical elliptical path with compound vertical and tilting movement.

8 Claims, 8 Drawing Figures

AMUSEMENT RIDE APPARATUS

SUMMARY OF THE INVENTION

The apparatus of the invention provides a unique, entertaining and enjoyable ride for children for amusement purposes in shopping malls, supermarkets and the like. The apparatus may be coin operated and each seat is self-propelled through defined compound tilting and vertical movements at a single riding location. The operating mechanisms are completely shielded against tampering or accidental contact so that the ride is safe both to the riders and to on-looking children.

DETAILED DESCRIPTION OF THE INVENTION

Figure 1:
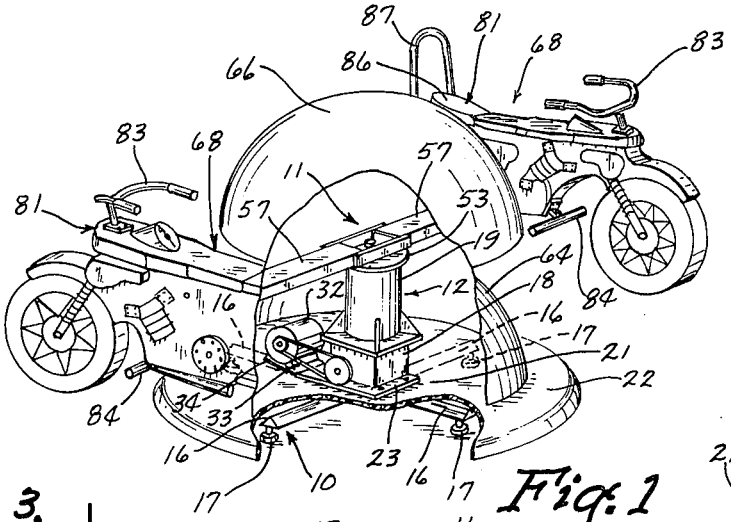
FIG. 1 is a perspective view of the ride apparatus of this invention with portions broken away to more clearly show its construction.
Figures 5, 6, 7:
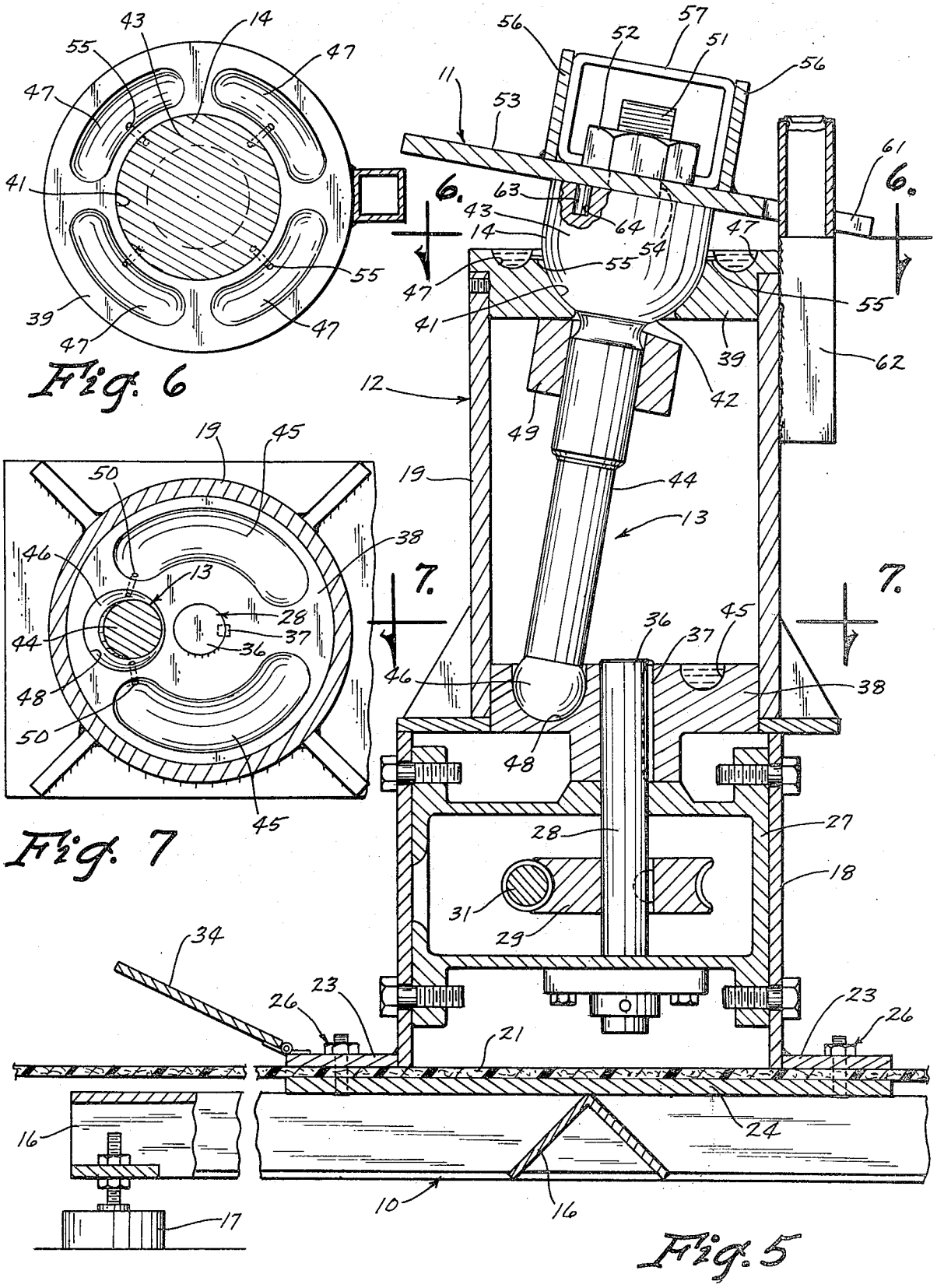
FIG. 5 is an enlarged sectional view taken along line 5—5 in FIG. 2 showing the motion transmitting mechanism of the apparatus.
FIGS. 6 and 7 are sectional views taken on lines 6—6 and 7—7, respectively, of FIG. 5.

With reference to FIGS. 1 and 5 of the drawings, the amusement or ride apparatus of this invention is illustrated as comprising a base frame 10, an occupant supporting structure 11, an upright housing unit 12 mounted on the base frame and a motion transmitting mechanism 13 within the housing unit having an output portion 14 projected upwardly from the housing unit for carrying the occupant supporting structure 11.

The base frame 10 includes leg members 16, illustrated as four in number, and secured together into a cross shape. The leg members 16 are of an angle iron construction with their apex portions faced upwardly. Adjustably secured at the free end of each leg member 16 is a rubber mounting assembly 17 providing for the level support of the base frame 10 on a floor or concrete surface.

The housing unit 12 (FIGS. 1 and 5) includes a bottom tubular housing structure 18 of a generally square shape in transverse section to the upper end of which is secured, as by weldments, a top tubular housing structure 19 of a cylindrical shape in transverse cross section. The central portion 21 of a flat fiberglass cover 22 for the base frame 10 is sandwiched between mounting flanges 23 at the lower end of the bottom housing structure 18 and a flange mounting plate 24 secured to the top and central section of the base frame 10. This sandwich arrangement is secured together by bolt assemblies 26 whereby the housing unit 12 is rigidly fixed to the base frame 10.

The motion transmitting mechanism 13 (FIG. 5) includes a bearing housing 27 arranged within the bottom housing structure 18 for rotatably supporting a vertical shaft 28 on which is mounted a worm gear 29. A worm shaft 31, operatively associated in a driving relation with the worm gear 29, is rotatably projected laterally from the bearing housing 27 for connection with a drive motor 32 (FIG. 1) through a belt and pulley assembly 33. The motor 32 is carried on a hinge plate 34 (FIG. 5) hingedly connected to and constituting an extension of a mounting flange 23 on the bottom housing structure 18.

The upper end 36 of the vertical shaft 28 projects upwardly within the lower end of the top housing structure 19 and has keyed thereto, as indicated at 37, a rotatable horizontal drive member 38 of a disc shape. A horizontal member 39, also of a disc shape, is located within and is secured to the upper end of the top housing structure 19 so as to be disposed vertically above the rotatable drive member 38. The upper surface of the stationary member 39 (FIGS. 5 and 6) is formed with a central recess or socket 41 having a bottom opening 42. Both the socket 41 and the bottom opening 42 are concentrically arranged relative to the axis of the vertical shaft 28.

An upright motion transmitting member 43 interconnects the rotatable drive member 38, the stationary member 39 and the occupant supporting structure 11. The transmitting member has an elongated shank section 44 terminating at its lower end in a ball portion 46 of a reduced diameter relative to the ball or output portion 14 formed at the upper end of the shank section 44. The lower ball portion 46 and the shank section 44 are of a size to be inserted through the bottom opening 42 of the socket 41 to provide for the seating of the upper ball portion 14 within the socket 41. When the motion transmitting member 43 is so inserted the lower ball portion 46 is seated within an associated socket 48 (FIGS. 5 and 7) formed in the upper surface of the rotatable drive member 38 at a position radially off-set from the rotational axis of the vertical shaft 28. Grease receiving cavities 45 and 47 formed in the upper surfaces of the members 38 and 39, respectively, are connected by passages 50 and 55 with the sockets 48 and 41, also respectively.

A stop collar 49 is secured to the shank section 44 for bearing engagement with the under side of the stationary member 39 to retain the motion transmitting member 43 against upward movement out of its ball and socket connections with the rotatable drive member 38 and stationary member 39. It is seen, therefore, that in response to a rotation of the drive member 38 the upper ball portion 14 is rockably moved within its associated socket 41 in a gyrating motion relative to the axis of the vertical shaft 28.

Figure 2:
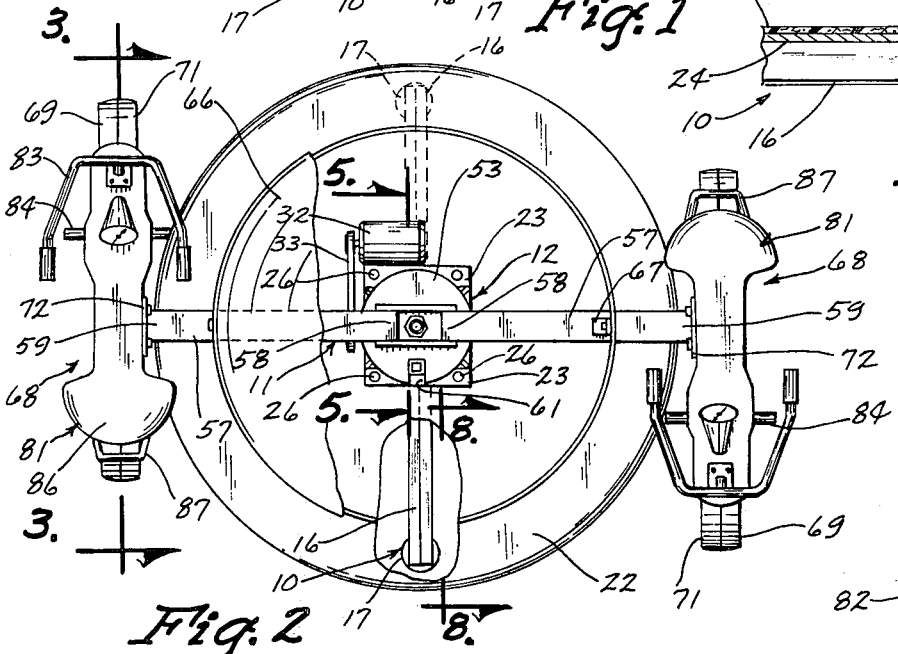
FIG. 2 is a plan view of the apparatus shown in FIG. 1 with portions broken away.

Projected upwardly from the upper ball portion 14 in axial alignment with the shank section 44 is a stud 51 for threaded engagement with an associated nut 52 for securing the occupant supporting structure 11 to the upper ball portion 14. The supporting structure 11 (FIGS. 2 and 5) includes a circular plate member 53 formed with a central opening 54 for receiving the stud 51. Projected upwardly from the mounting plate 53 and in a parallel relation at opposite sides of the central opening 54 are a pair of connecting members 56. A pair of like tubular beam members 57 of a square shape in transverse cross section are arranged in axial alignment with their inner adjacent ends 58 positioned between and secured to the connecting members 56 in a spaced relation so as to provide clearance with the securing nut 52.

As thus far described, it is seen that on rotation of the drive member 38 and a resultant gyration of the upper ball portion 14 within the socket 41 that the outer ends 59 of the beam members 57 rotate relative to the axis of the vertical shaft 28 in a generally sine wave path. To prevent such rotation and to provide for the unique compound ride movement of the beam outer ends 59 at transversely opposite stations one side of the mounting plate 53 is formed with a radially extended guide notch 61 (FIG. 5). A coacting upright guide member 62 receivable within the notch 61 for bearing engagement with the opposite sides thereof is secured to and projected upwardly from the top housing structure 19. A locking pin 63 projects downwardly from the lower side of the mounting plate 53 into an associated hole 64 formed in the upper ball portion 14. This arrangement provides for a tightening of the nut 52 on the stud 51 while retaining a working bearing engagement between the guide member 62 and the opposite side walls of the guide notch 61.

With the elimination of rotation of the beam members 57 relative to the axis of the shaft 28, the outer ends 59 thereof are permitted to oscillate in a generally upright elliptical path concurrently with having a tilting undulating or teetering movement over the full range of vertical movement, thereby simulating generally the ride of a motorcycle over an uneven terrain.

Figure 8:
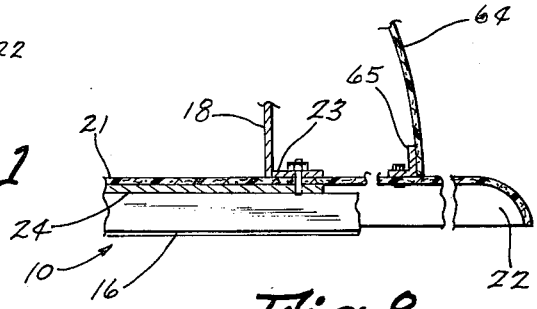
FIG. 8 is a sectional view as seen on line 8—8 of FIG. 2.

As previously mentioned, there is provided a fiberglass cover 22 for the base frame 10. A generally dome shaped cover 64 for the housing unit 12 (FIG. 1) is equipped with circumferentially spaced brackets 65 (FIG. 8) about its lower end for securement to the cover 22. A central opening (not shown) is formed within the upper portion of the housing cover 64 for projection therethrough of the upper end of the top housing structure 19. The occupant supporting structure 11, except for the beam outer ends 59, is shielded by a top cover 66 (FIGS. 1 and 2) which is suitably secured, as by brackets 67, directly to the beam members 57. It is seen, therefore, that only the outer ends 59 of the beam members 57 are exposed from the arrangement of the cover members 22, 64 and 66.

Figure 3:
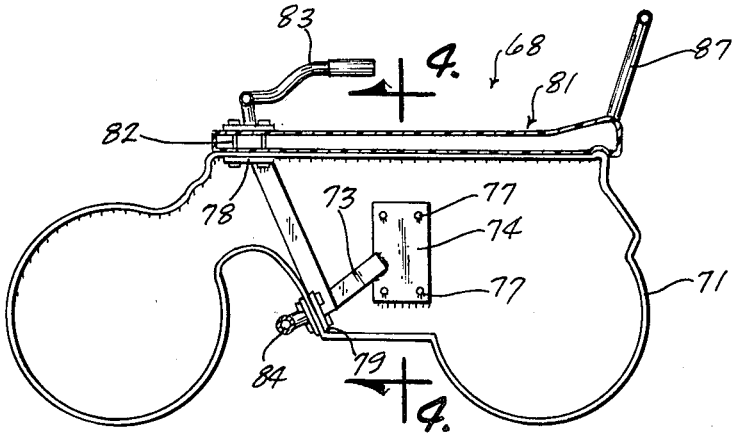
FIG. 3 is an enlarged sectional view taken on line 3—3 of FIG. 2.
Figure 4:
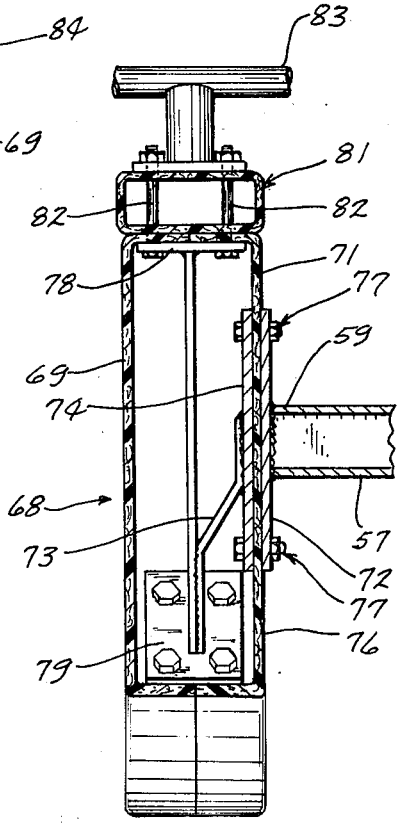
FIG. 4 is an enlarged detail sectional view as seen along line 4—4 in FIG. 3.

Secured to the outer end 59 of each beam member 57 is a like seat unit 68 simulating in appearance a motorcycle and comprised essentially of a pair of mating half sections 69 and 71 formed of a fiberglass material (FIGS. 3 and 4). The outer end 59 of a beam 57 carries a plate member 72 and a seat unit 68 has a mounting bracket 73 provided with a corresponding plate member 74. The side 76 of the cycle half section 71 is clamped between the plate members 72 and 74 by bolt assemblies 77. The mounting bracket 73 also includes an upper hand plate 78 and a foot plate 79 which are common to both of the half sections 69 and 71 and are secured thereto as shown in FIG. 4. A combined seat and instrument panel unit 81 is secured to and covers the top sides of the assembled half sections 69 and 71 by means including connecting bolts 82 which also serve to connect a handle bar member 83 to the hand plate 78. As best appears in FIG. 3, the foot plate 79 has secured thereto a foot rest or bar 84. The seat portion 86 of the unit 81 may be provided with a backrest 87 and a safety belt (not shown).

Although the invention has been described with respect to a preferred embodiment thereof, it is to be understood that it is not to be so limited since changes and modifications can be made therein which are within the full intended scope of this invention as defined by the appended claims.

I claim:

1. An amusement ride apparatus comprising:

a. a base frame,
b. an upright housing means mounted on said base frame,
c. a horizontal rotatable drive member rotatably supported in said housing means having adjacent the periphery thereof an upwardly facing ball receiving socket,
d. a fixed horizontal member in said housing means spaced vertically above said drive member and formed with an upwardly facing ball-receiving socket having an opening in the bottom side thereof and arranged concentric with the axis of rotation of said drive member,
e. an elongated upright motion transmitting member in said housing means interconnected with said rotatable drive member and fixed horizontal member having ball portions at opposite ends thereof for reception within respective ones of said ball-receiving sockets,
f. an occupant supporting means fixedly mounted on the upper one of said ball portions and extended transversely of said housing means,
g. coacting guide means on said housing means and occupant supporting means to prevent horizontal rotational movement of said occupant supporting means while permitting reciprocal vertical oscillation thereof on rotation of said drive member,
h. an occupant seat secured at each end of said occupant supporting means, and
i. means to drive said drive member.

2. An amusement ride apparatus comprising:

a. a base frame,
b. an upright tubular housing structure mounted on said base frame,
c. a horizontal rotatable drive member in said housing structure,
d. a horizontal stationary member located within and adjacent the upper end of said housing structure and spaced vertically above said drive member,
e. an upright motion transmitting member in said housing structure interconnected with said drive member and stationary member,
f. a first socket and ball connection for connecting the lower end of said motion transmitting member with said drive member at a position offset from the axis of rotation of said drive member,
g. a second socket and ball connection for connecting the upper end of said motion transmitting member with said stationary member, said second socket and ball connection including a ball portion at the upper end of said motion transmitting member, and a socket portion formed in the upper surface of said stationary member having an open bottom for extension therethrough of said motion transmitting member, said second socket portion arranged in a concentric relation with the axis of rotation of said drive member,
h. an elongated occupant supporting means secured to said ball portion and extended transversely across the upper end of said housing structure,
i. coacting means on said supporting means and housing structure to prevent horizontal rotational movement of said supporting means,
j. a seat structure secured at each end of said occupant supporting means, and
k. means to drive said drive member.

3. An amusement ride apparatus comprising:

a. a base means, b. an upright tubular housing structure mounted on said base means, c. an elongated occupant supporting structure extended transversely across the upper end of said housing structure having occupant seats secured thereto, d. means for moving said occupant supporting structure for oscillation in a vertical plane, said means for moving including, e. a horizontal rotatable drive member in said housing structure, f. a horizontal stationary member arranged in said housing structure adjacent the upper end thereof and above said drive member, g. an upright motion transmitting member in said housing structure interconnecting said supporting structure, drive member and stationary member and projected through an opening in said stationary member with the lower end connectible with said drive member, h. a first socket and ball connection for connecting said lower end with the drive member at a position offset from the axis of rotation of said drive member, i. a second socket and ball connection for connecting said upper end with the stationary member and said upper end having a ball portion on said transmitting member and an upwardly facing socket portion in said stationary member concentric with the rotational axis of said drive member, j. means securing said supporting structure to the upper end of said motion transmitting member, k. coacting means on said supporting structure and housing structure to confine said supporting structure against horizontal rotational movement about the axis of said drive member, and l. means to drive said drive member.

4. The amusement apparatus according to claim 3, wherein:

a. said coacting means includes an upright guideway on said occupant supporting structure and an upright stationary guide member on said housing structure in bearing engagement with said guideway.

5. The amusement apparatus according to claim 3, wherein said means to drive said drive member includes:

a. an electric motor means on said base means, and b. means connecting said motor means in a driving relation with said drive member.

6. The amusement apparatus according to claim 3 wherein:

a. said stationary member is formed in the upper surface thereof with lubricant-receiving cavities and passage means for supplying lubricant from said cavities to said second socket and ball connection, and b. said drive member is formed in the upper surface thereof with other lubricant-receiving cavities and passage means for supplying lubricant from said other cavities to said first socket and ball connection.

7. The amusement apparatus according to claim 3 wherein:

a. said socket portion has a bottom wall with said opening therein, and b. said lower end of the motion transmitting member is of a size to pass through said opening.

8. The amusement apparatus according to claim 7, including:

a. a stop member secured to said motion transmitting member for bearing engagement with the lower side of said stationary member whereby to confine said motion transmitting member against upward movement.

* * * * *